US009153221B2

(12) United States Patent
Ribner

(10) Patent No.: US 9,153,221 B2
(45) Date of Patent: Oct. 6, 2015

(54) TIMPANI TUNING AND PITCH CONTROL SYSTEM

(71) Applicant: David Byrd Ribner, Andover, MA (US)

(72) Inventor: David Byrd Ribner, Andover, MA (US)

(73) Assignee: Overtone Labs, Inc., Lawrence, MA (US)

( * ) Notice: Subject to any disclaimer, the term of this patent is extended or adjusted under 35 U.S.C. 154(b) by 0 days.

(21) Appl. No.: 14/022,573

(22) Filed: Sep. 10, 2013

(65) Prior Publication Data

US 2014/0069258 A1 Mar. 13, 2014

Related U.S. Application Data

(60) Provisional application No. 61/699,559, filed on Sep. 11, 2012.

(51) Int. Cl.

| | |
|---|---|
| ***G10H 1/44*** | (2006.01) |
| ***G10G 7/02*** | (2006.01) |
| ***G10D 13/04*** | (2006.01) |

(52) U.S. Cl.

CPC ..... *G10H 1/44* (2013.01); *G10D 13/04* (2013.01); *G10G 7/02* (2013.01)

(58) Field of Classification Search

USPC ..... 84/419, 454
IPC ..... G10H 1/44
See application file for complete search history.

(56) References Cited

U.S. PATENT DOCUMENTS

| | | | | |
|---|---|---|---|---|
| 2,584,277 | A * | 2/1952 | Long | 331/75 |
| 3,144,802 | A * | 8/1964 | Faber, Jr. et al. | 84/454 |
| 3,638,113 | A * | 1/1972 | Glorioso et al. | 324/76.66 |
| 3,691,894 | A | 9/1972 | Schneider et al. | |
| 3,881,389 | A * | 5/1975 | Allen | 84/454 |
| 4,023,462 | A | 5/1977 | Denov et al. | |
| 4,044,239 | A * | 8/1977 | Shimauchi et al. | 700/280 |
| 4,088,052 | A * | 5/1978 | Hedrick | 84/454 |
| 4,196,652 | A * | 4/1980 | Raskin | 84/458 |
| 4,207,791 | A * | 6/1980 | Murakami | 84/672 |
| 4,276,804 | A * | 7/1981 | Holland | 84/394 |
| 4,287,806 | A | 9/1981 | Neary | |
| 4,319,515 | A | 3/1982 | Mackworth-Young | |

(Continued)

FOREIGN PATENT DOCUMENTS

| | | |
|---|---|---|
| JP | 2002516418 | 6/2002 |
| JP | 2005301318 | 10/2005 |

(Continued)

OTHER PUBLICATIONS

International Search Report and Written Opinion in related international patent application No. PCT/US2011/020751, mailed on Sep. 28, 2011; 12 pages.

(Continued)

*Primary Examiner* — David Warren

(74) *Attorney, Agent, or Firm* — Schmeiser, Olsen & Watts LLP

(57) ABSTRACT

Provided are a percussion instrument tuning system and method. A position sensor determines at least one first position of a tuning mechanism of a timpano. A control unit generates a calibration result by measuring a first pitch of the timpano corresponding to the at least one first position of the tuning mechanism and estimates a second pitch of the timpano corresponding to at least one second position of the tuning mechanism from the calibration result.

15 Claims, 10 Drawing Sheets

(56) References Cited

U.S. PATENT DOCUMENTS

| | | | | |
|---|---|---|---|---|
| 4,369,687 | A | 1/1983 | Meyers | |
| 4,426,907 | A * | 1/1984 | Scholz | 84/454 |
| 4,453,448 | A * | 6/1984 | Miesak | 84/454 |
| 4,481,857 | A | 11/1984 | Havener | |
| 4,539,518 | A | 9/1985 | Kitayoshi | |
| 4,584,923 | A * | 4/1986 | Minnick | 84/454 |
| 4,741,242 | A | 5/1988 | Aronstein | |
| 4,803,908 | A * | 2/1989 | Skinn et al. | 84/454 |
| 4,899,636 | A | 2/1990 | Chiba et al. | |
| 4,909,126 | A * | 3/1990 | Skinn et al. | 84/454 |
| 4,941,384 | A * | 7/1990 | Jager | 84/313 |
| 4,958,550 | A * | 9/1990 | Kugimoto | 84/454 |
| 5,009,142 | A * | 4/1991 | Kurtz | 84/454 |
| 5,038,657 | A * | 8/1991 | Busley | 84/455 |
| 5,095,797 | A * | 3/1992 | Zacaroli | 84/455 |
| 5,323,680 | A * | 6/1994 | Miller et al. | 84/455 |
| 5,388,496 | A * | 2/1995 | Miller et al. | 84/454 |
| 5,423,241 | A | 6/1995 | Scarton et al. | |
| 5,487,320 | A * | 1/1996 | De Mowbray | 84/413 |
| 5,598,505 | A | 1/1997 | Austin et al. | |
| D378,683 | S * | 4/1997 | Ridinger | D17/99 |
| 5,726,362 | A | 3/1998 | Boyden | |
| 5,728,959 | A | 3/1998 | O'Rorke | |
| 5,770,810 | A * | 6/1998 | Lombardi | 84/411 R |
| 5,808,218 | A * | 9/1998 | Grace | 84/456 |
| 5,824,929 | A * | 10/1998 | Freeland et al. | 84/454 |
| D402,684 | S | 12/1998 | Wilson et al. | |
| 5,859,378 | A * | 1/1999 | Freeland et al. | 84/454 |
| 5,920,026 | A | 7/1999 | Yoshino et al. | |
| 5,986,190 | A * | 11/1999 | Wolff et al. | 84/297 R |
| 5,990,403 | A | 11/1999 | Membreno et al. | |
| 6,066,790 | A | 5/2000 | Freeland et al. | |
| 6,121,538 | A | 9/2000 | Yoshino et al. | |
| 6,271,458 | B1 | 8/2001 | Yoshino et al. | |
| 6,437,226 | B2 * | 8/2002 | Oudshoorn et al. | 84/454 |
| 6,465,723 | B2 * | 10/2002 | Milano | 84/454 |
| 6,725,108 | B1 | 4/2004 | Hall | |
| 6,756,535 | B1 | 6/2004 | Yoshino et al. | |
| 6,797,872 | B1 | 9/2004 | Catalano et al. | |
| 6,809,249 | B2 | 10/2004 | Stuebner et al. | |
| 6,812,392 | B2 | 11/2004 | Brando | |
| 6,925,880 | B1 | 8/2005 | Roberts | |
| 6,996,523 | B1 | 2/2006 | Bhaskar et al. | |
| 7,049,502 | B2 | 5/2006 | Taku et al. | |
| 7,074,998 | B2 | 7/2006 | Hurwicz | |
| 7,265,282 | B2 | 9/2007 | Membreno et al. | |
| 7,271,329 | B2 | 9/2007 | Franzblau | |
| 7,272,556 | B1 | 9/2007 | Aguilar et al. | |
| 7,288,709 | B2 | 10/2007 | Chiba | |
| 7,323,629 | B2 | 1/2008 | Somani et al. | |
| 7,371,954 | B2 | 5/2008 | Masuda et al. | |
| 7,376,553 | B2 | 5/2008 | Quinn | |
| 7,385,135 | B2 | 6/2008 | Yoshino et al. | |
| 7,390,951 | B2 | 6/2008 | Dulaney et al. | |
| 7,446,248 | B2 * | 11/2008 | Skinn et al. | 84/312 R |
| 7,493,254 | B2 | 2/2009 | Jung et al. | |
| 7,495,161 | B1 | 2/2009 | Richards | |
| 7,507,891 | B2 | 3/2009 | Lau et al. | |
| 7,547,840 | B2 | 6/2009 | Noh et al. | |
| 7,598,447 | B2 | 10/2009 | Walker et al. | |
| 7,618,322 | B2 | 11/2009 | Shimizu et al. | |
| 7,655,851 | B2 | 2/2010 | Nagakura | |
| 7,672,843 | B2 | 3/2010 | Srinivasan et al. | |
| 7,692,085 | B2 * | 4/2010 | Adams | 84/454 |
| 7,763,789 | B2 | 7/2010 | Clark | |
| 7,786,373 | B2 * | 8/2010 | Adams | 84/728 |
| 7,851,686 | B1 | 12/2010 | Davidson | |
| 7,851,690 | B1 * | 12/2010 | Stahnke | 84/723 |
| 7,888,568 | B2 * | 2/2011 | Kashioka | 84/41 |
| 7,935,876 | B1 * | 5/2011 | West | 84/304 |
| 7,968,780 | B2 | 6/2011 | Millender et al. | |
| 7,982,114 | B2 | 7/2011 | Applewhite et al. | |
| 8,076,564 | B2 | 12/2011 | Applewhite | |
| 8,203,063 | B2 | 6/2012 | Truda | |
| 8,244,527 | B2 | 8/2012 | Srinivasan et al. | |
| 8,283,544 | B2 | 10/2012 | Zuffante et al. | |
| 8,309,834 | B2 | 11/2012 | Gehring et al. | |
| 8,334,449 | B2 | 12/2012 | Nielsen et al. | |
| 8,502,060 | B2 | 8/2013 | Ribner | |
| 8,546,678 | B1 | 10/2013 | Stevens | |
| 8,642,874 | B2 | 2/2014 | Ribner | |
| 8,742,242 | B1 | 6/2014 | Ribner | |
| 8,759,655 | B2 | 6/2014 | Ribner | |
| 8,772,617 | B1 | 7/2014 | McGee et al. | |
| 2002/0184992 | A1 * | 12/2002 | Brando | 84/411 R |
| 2004/0089136 | A1 | 5/2004 | Georges et al. | |
| 2005/0223880 | A1 | 10/2005 | Yoshino et al. | |
| 2005/0232411 | A1 | 10/2005 | Srinivasan et al. | |
| 2006/0037459 | A1 * | 2/2006 | Skinn et al. | 84/312 R |
| 2007/0084328 | A1 * | 4/2007 | Kashioka | 84/413 |
| 2007/0084330 | A1 | 4/2007 | Okuyama | |
| 2008/0052068 | A1 | 2/2008 | Aguilar et al. | |
| 2008/0173158 | A1 | 7/2008 | Lee | |
| 2008/0229907 | A1 | 9/2008 | Clark | |
| 2009/0271182 | A1 | 10/2009 | Athineos et al. | |
| 2009/0288547 | A1 * | 11/2009 | Lazovic | 84/645 |
| 2010/0043624 | A1 | 2/2010 | Nagakura | |
| 2010/0083812 | A1 | 4/2010 | Peavey | |
| 2010/0195837 | A1 | 8/2010 | Srinivasan et al. | |
| 2010/0212475 | A1 * | 8/2010 | Toulson | 84/454 |
| 2011/0252943 | A1 * | 10/2011 | Zuffante et al. | 84/413 |
| 2012/0174734 | A1 * | 7/2012 | Dorfman et al. | 84/422.1 |
| 2012/0240749 | A1 * | 9/2012 | Bjornson | 84/454 |
| 2014/0069258 | A1 * | 3/2014 | Ribner | 84/419 |
| 2014/0096666 | A1 | 4/2014 | Ribner | |

FOREIGN PATENT DOCUMENTS

| | | |
|---|---|---|
| JP | 2006227452 | 8/2006 |
| JP | 2006010869 | 12/2006 |
| JP | 2008070581 | 3/2008 |
| JP | 2008090058 | 4/2008 |
| JP | 2008090202 | 4/2008 |
| JP | 2008129539 | 5/2008 |
| JP | 2009528550 | 8/2009 |
| JP | 2010061107 | 3/2010 |
| WO | 2009010713 | 1/2009 |

OTHER PUBLICATIONS

Toulson, Rob et al., "The perception and importance of drum tuning in live performance and music production", Journal on the Art of Record Production, ISSN 1754-9892, Issue 4, Oct. 2009; 7 pages.

Toulson, Rob, "Percussion Acoustics and Quantitative Drum Tuning", Audio Engineering Society Tutorial T3, New York, Oct. 2009; 30 pages.

Richardson, Phillip et al, "Fine Tuning Percussion—A New Educational Approach", 2010; 18 pages.

PGM Richardson et al., "Clearing the Drumhead by Acoustic Analysis Method", 2010; 8 pages.

Worland, Randy, "Normal Modes of a Musical Drumhead Under Non-Uniform Tension", Journal of the Acoustical Society of America, Jan. 2010; 10 pages.

Sunohara, Masahiro et al., "The Acoustics of Japanese Wooden Drums called "Mokugyo"", Journal of the Acoustical Society of America, Apr. 2005; 13 pages.

International Search Report and Written Opinion in related international application No. PCT/US2012/066999, mailed on Mar. 13, 2013; 12 pages.

Non-Final Office Action in related U.S. Appl. No. 13/004,166, mailed on Apr. 2, 2013; 8 pages.

Notice of Allowance and Fee(s) Due in related U.S. Appl. No. 13/768,799, mailed on Feb. 15, 2013; 9 pages.

Final Office Action in related U.S. Appl. No. 13/004,166, mailed on Sep. 11, 2013; 7 pages.

Non-Final Office Action in related U.S. Appl. No. 13/886,342, mailed on May 3, 2013; 13 pages.

Notice of Allowance and Fee(s) Due in related U.S. Appl. No. 13/004,166, mailed on Oct. 30, 2013; 9 pages.

Supplemental Notice of Allowance and Fee(s) Due in related U.S. Appl. No. 13/004,166, mailed on Jan. 9, 2014; 7 pages.

(56) References Cited

OTHER PUBLICATIONS

Notice of Allowance and Fee(s) Due in related U.S. Appl. No. 13/886,342, mailed on Jan. 16, 2014; 12 pages.
International Preliminary Report on Patentability in related international patent application No. PCT/US12/66999, mailed on Jun. 12, 2014; 8 pages.
Non-Final Office Action in related U.S. Appl. No. 13/688,822, mailed on Mar. 5, 2014; 22 pages.
Notice of Allowance in related U.S. Appl. No. 13/688,822, mailed on Apr. 29, 2014; 12 pages.
"RESOTUNE Electronic Drum Tuner Online Operations Manual", accessed Apr. 15, 2011; 14 pages.
Non-Final Office Action in related U.S. Appl. No. 14/101,845, mailed on Nov. 6, 2015; 8 pages.
Non-Final Office Action in related U.S. Appl. No. 14/200,218, mailed on Feb. 18, 2015; 12 pages.

* cited by examiner

TIMPANI TUNING AND PITCH CONTROL SYSTEM

RELATED APPLICATIONS

This application claims the benefit of U.S. Patent Application No. 61/699,559 filed Sep. 11, 2012, the entirety of which is incorporated by reference herein.

This application is related to U.S. patent application Ser. No. 13/004,166, filed Jan. 11, 2011, entitled "Drum and Drum-Set Tuner", and published as U.S. Patent Application Publication No. 2011/0179939, U.S. patent application Ser. No. 13/688,822 filed Nov. 29, 2012, and U.S. patent application Ser. No. 13/886,342 filed May 3, 2013, the entirety of each of which is incorporated by reference herein.

FIELD OF THE INVENTION

The present inventive concepts relate generally to single-headed percussion instruments, and more specifically, to tuning and pitch control systems and methods for timpani or related drums.

BACKGROUND

Timpani are well-known musical instruments, more specifically, single-headed drums used in orchestras, marching bands, or other musical ensembles.

Timpani are typically tuned by using individual pedals to adjust the tension of the drum head, which in turn, changes the pitch of the drum.

SUMMARY

In one aspect, provided is a percussion instrument tuning system, comprising: a position sensor that determines at least one first position of a tuning mechanism of a timpano; and a control unit that generates a calibration result by measuring a first pitch of the timpano corresponding to the at least one first position of the tuning mechanism, and that estimates a second pitch of the timpano corresponding to at least one second position of the tuning mechanism from the calibration result.

In another aspect, provided is a method for tuning a timpano, comprising: determining at least one first pedal position of a timpano; generating a calibration result by measuring a first pitch of the timpano corresponding to the at least one first position of the pedal; and estimating a second pitch of the timpano corresponding to at least one second position of the tuning mechanism from the calibration result.

In another aspect, provided is a method for method for tuning a timpano, comprising: specifying a reference value corresponding to a desired timpano pitch; applying a force at a timpano head location; determining a deviation between a measured pitch value in response to the force applied at the timpano head location and the reference value; and adjusting the timpano at the timpano head location in response to a determination that the deviation is greater than a threshold value.

BRIEF DESCRIPTION OF THE DRAWINGS

The above and further advantages of this invention may be better understood by referring to the following description in conjunction with the accompanying drawings, in which like numerals indicate like structural elements and features in the various figures. For clarity, not every element may be labeled in every figure. The drawings are not necessarily to scale, emphasis instead being placed upon illustrating the principles of the invention.

DETAILED DESCRIPTION

Reference in the specification to "one embodiment" or "an embodiment" means that a particular, feature, structure or characteristic described in connection with the embodiment is included in at least one embodiment of the teaching. References to a particular embodiment within the specification do not necessarily all refer to the same embodiment.

The present teaching will now be described in more detail with reference to exemplary embodiments thereof as shown in the accompanying drawings. While the present teaching is described in conjunction with various embodiments and examples, it is not intended that the present teaching be limited to such embodiments. On the contrary, the present teaching encompasses various alternatives, modifications and equivalents, as will be appreciated by those of skill in the art. Those of ordinary skill having access to the teaching herein will recognize additional implementations, modifications and embodiments, as well as other fields of use, which are within the scope of the present disclosure as described herein.

In brief overview, provided is an electronic tuning system that incorporates pitch measurement functionality for significantly improved accuracy and ease of use. This tuning system directly measures the drum's pitch, thus eliminating the need to estimate the pitch by ear. The electronic timpani tuner includes a simple calibration procedure that enables a note pitch to be set with improved accuracy. In particular, the tuning system can generate calibration data by measuring a pitch at a timpano corresponding to each of one or more positions of the timpano tuning pedal or other tuning mechanism. The calibration data can be used to estimate subsequent pitch values for each of a plurality of different timpano pedal positions. The estimated pitch values and/or actual measured pitch values can be displayed, depending on whether the system is configured for a calibration mode or a performance mode. The display of estimated pitch values in performance mode, for various pedal positions, provides the function of an electronic tuning gauge. Accordingly, the tuning system can be incorporated in new timpani designs or can be affixed to existing timpani, and is especially useful for existing timpani lacking tuning gauges.

The tuning system can enable the equalization of drum-head pitch adjacent to each tuning screw of the drum to improve overall drum tone, also known as clearing a drumhead. In some embodiments, the tuning system enables drumheads to be equalized with high precision and consequently improves the overall tone of a timpano.

Figure 1:
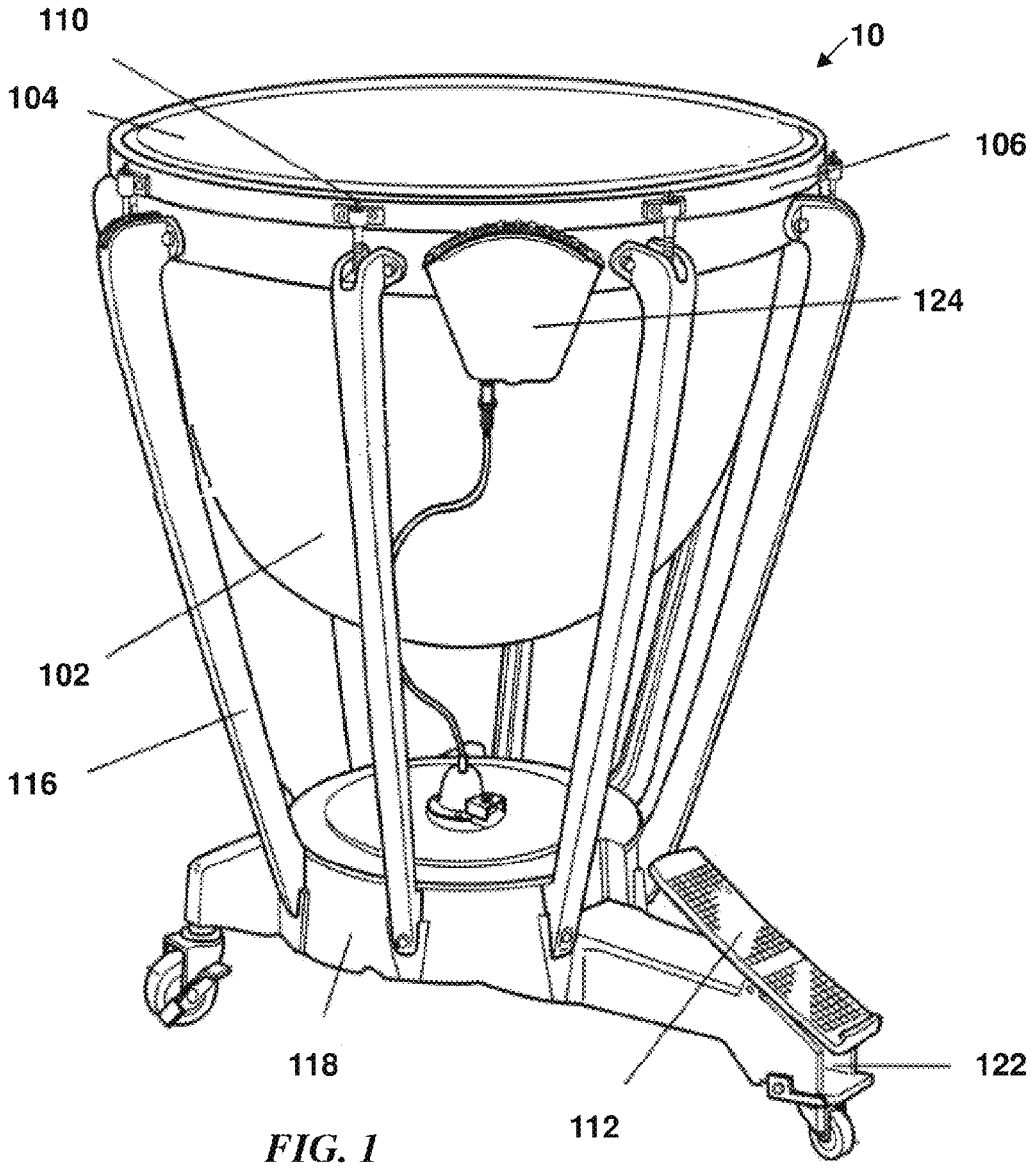
FIG. 1 is a perspective view of a timpano having a conventional tuning gauge.
Figure 2:
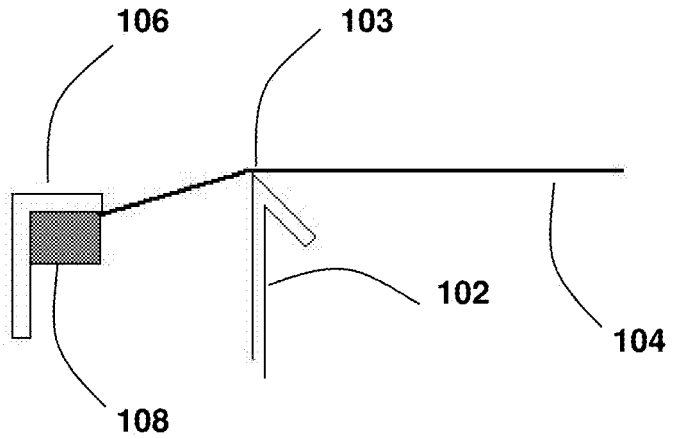
FIG. 2 is a close-up side view of a drum-head mounting and tensioning system of the timpano of FIG. 1.
Figure 3:
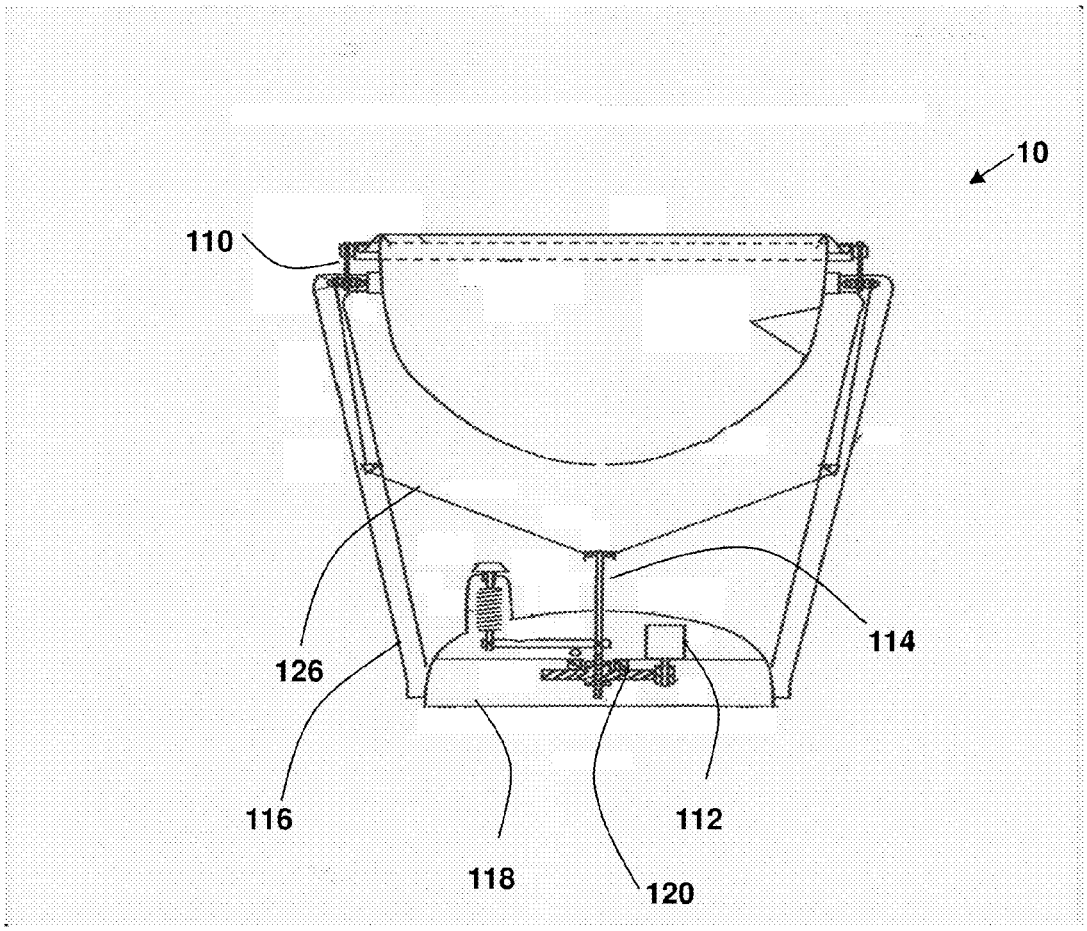
FIG. 3 is a cross-sectional front view of a timpano, in accordance with an embodiment.

FIG. 1 is a perspective view of a timpano 10 having a conventional tuning gauge 124. FIG. 2 is a side view of a drum-head mounting and tensioning system of the timpano 10 shown in FIG. 1. FIG. 3 is a cross-sectional view of a timpano 10, in accordance with an embodiment.

The timpano 10 can include a bowl 102, also referred to as a kettle or shell, with a head 104 stretched over a flesh hoop 108, or a metal ring about a perimeter of the bowl 102. The bowl 102 can be formed of copper, fiberglass, or other material known to those of ordinary skill in the art. The head 104 can be formed of gut, calfskin, plastic, or other stretchable material known to those of ordinary skill in the art. The head 104 can be held in place over the flesh hoop 108 at the bowl 102 by a counter hoop 106, for example, at a lip of the bowl 102 or a bearing edge 103 as shown in FIG. 2.

The counter hoop 106 is secured to the bowl 102 by a plurality of adjustable tension screws 110, or tension rods and the like, which are coupled to the hoop 106 and positioned around the drum head 104. In some embodiments, lugs or related receptacles are provided for holding a nut in place that a screw 110 can engage. The tension screws 110 can be used to secure and supply tension to the counter hoop 106, which in turn can tighten or loosen the skin of the drum head 104. Accordingly, a force applied by the tension rods 110 to the counter hoop 106 determines the tension of the drum head 104. When the tension screws 110 are tightened, the drum head 104 is stretched, which can raise the pitch of the timpano 10. When the tension screws 110 are loosened, the tension on the drum head 104 is reduced, which can lower the pitch of the timpano 10. The timpano 10 includes a series of struts 116 that extend between the bowl 102 and a base 118, and elevate the bowl 102 above the base 118.

The timpano 10 includes a tuning pedal 112 located at the base 118 and is pivotally coupled to a pedal support 122 at the base 118. The pedal 112 is directly or indirectly connected to the tension screws 110 via a plurality of cables or rods 126, commonly referred to as a spider assembly, and can therefore control the applied force to thereby adjust the tension and hence pitch of the timpano 10 when the tuning pedal 112 is pivotally moved up and down. The tuning pedal 112 can be coupled to a clutch 120 or the like for controlling the pedal positions and to vary the tension and hence pitch of the drum head 104. Other configurations for coupling can vary with the brand of timpani. Thus, when the pedal 112 is pressed down, a force is applied to tension cables 126 routed along the struts 116 which in turn communicate with the tension screws 110 to cause the drum head 104 to stretch, thereby increasing the pitch of the timpano 10. Similarly, when the pedal 112 is released, the tension screws 110 cause the drum head 104 to relax, thereby decreasing the pitch of the timpano 10.

The timpano 10 has a conventional mechanical tuning gauge 124 which provides a visual indication of the timpano's pitch based on either the pedal angle or counter hoop position. The tuning gauge 124 allows the timpanist to set the timpano 10 at the correct pitch before being sounded. The tuning gauge 124 can be controlled by the pedal 112. The tuning gauge 124 is physically connected either to the counterhoop 106, in which case the gauge 124 indicates how far the counterhoop 106 is pushed down by the pedal 112. Alternative, the tuning gauge 124 can be connected to the pedal 112, in which case the gauge 124 indicates the position of the pedal 112.

A conventional gauge such as the gauge 124 shown at FIG. 1 is inaccurate and needs to be calibrated due to imprecision in the tuning mechanism and variation in pitch of the drum head 104 due to temperature, humidity, or stretching. To calibrate the gauge 124, one must listen for the pitch of the drum and adjust the gauge 124 accordingly for each note. Calibrating the gauge 124 by ear, even with a pitch reference, introduces human error that can be significant, especially for less experienced musicians.

Many timpani fail to include such a gauge, requiring a percussionist to hit the drum in order to assess the pitch for each note or to provide estimates prior to striking the drum.

Figure 4:
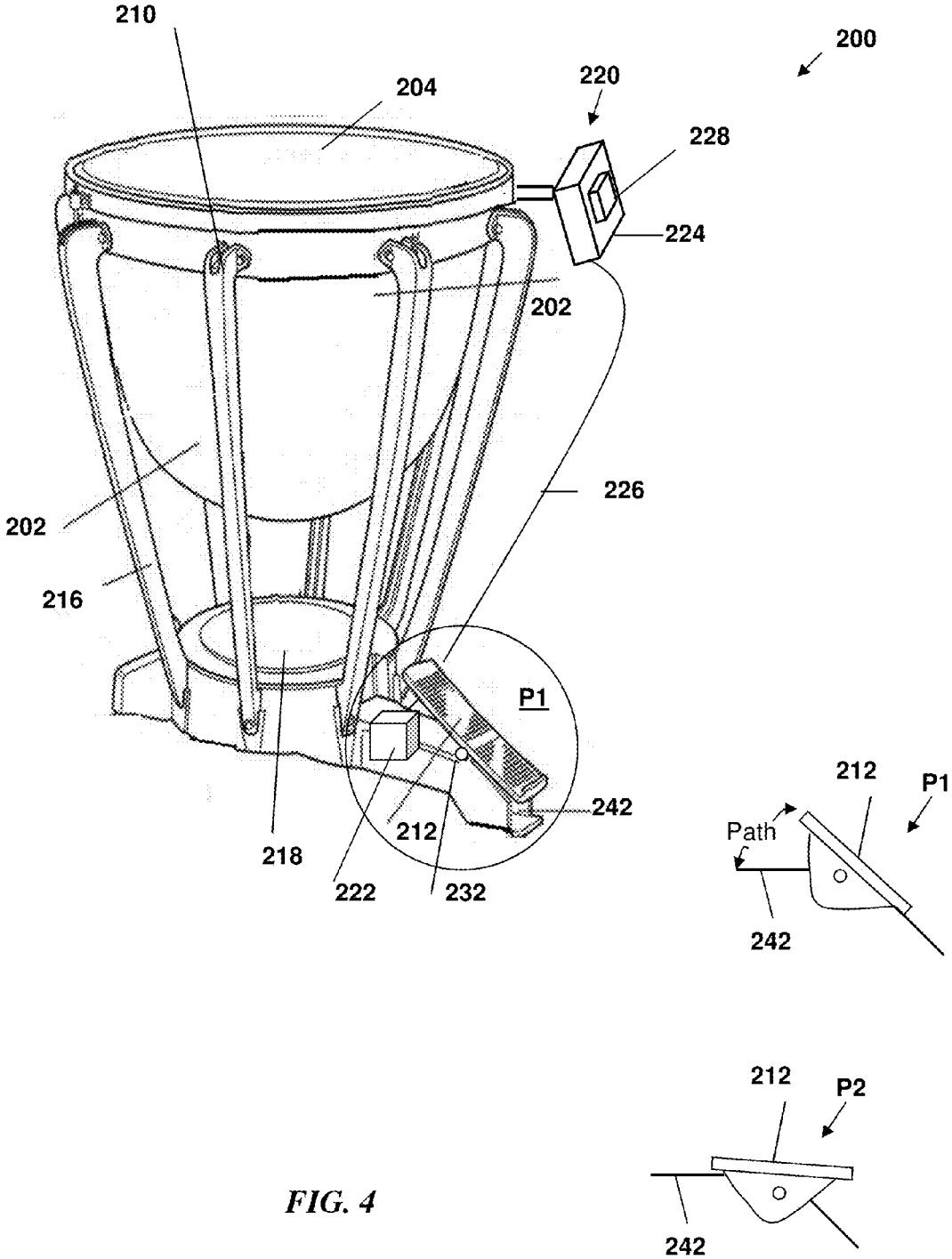
FIG. 4 is a perspective view of a timpano, in accordance with an embodiment.
Figure 5:
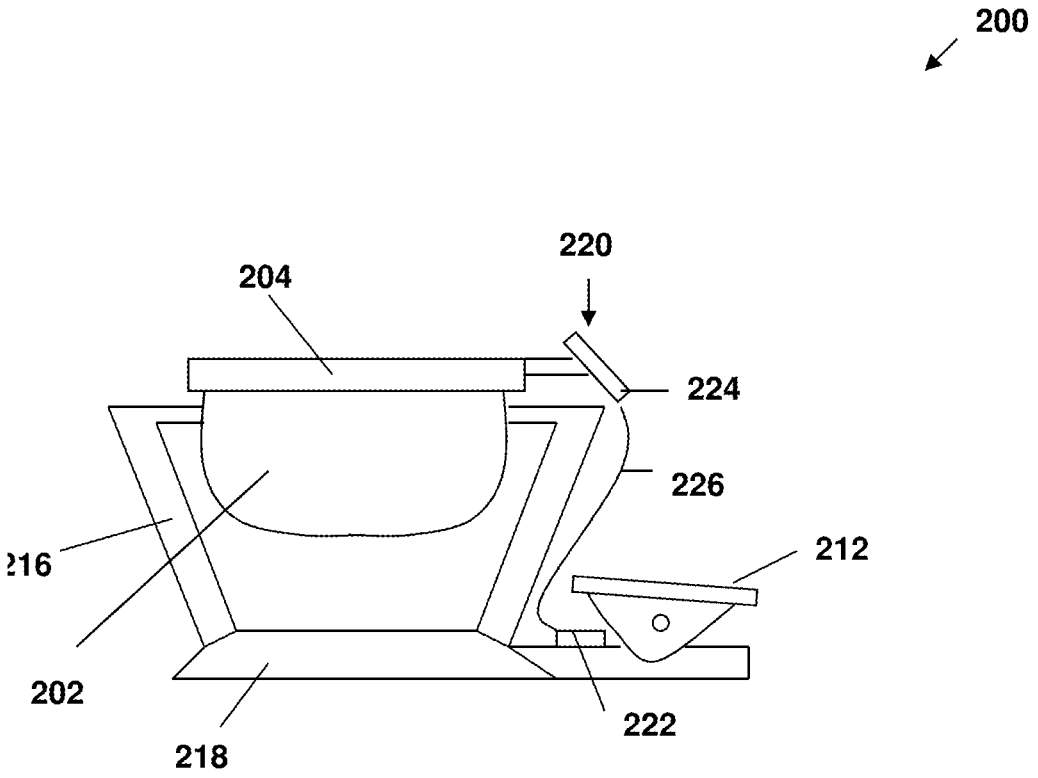
FIG. 5 is a side view of the timpano of FIG. 4.

FIG. 4 is a perspective view of a timpano 200, in accordance with an embodiment. FIG. 5 is a front view of the timpano 200 of FIG. 4. The timpano 200 can eliminate human error and allow for simple, quick calibration.

The timpano 200 includes a bowl 202, a head 204, a set of struts 216, a base 218, and other components similar to those described in the conventional timpano 10 of FIGS. 1-3. A detailed description of the similar or same components is not repeated due to brevity.

The timpano 200 incorporates a tuning system 220, which includes a pedal position sensor 222 in communication with a control unit 224. The timpani tuning system in accordance with embodiments of the present inventive concepts incorporates technology described in U.S. patent application Ser. No. 13/004,166, published as U.S. Patent Application Publication No. 2011/0179939 A1, entitled "Drum and Drum-Set Tuner," filed Jan. 11, 2011 by David Byrd Ribner, the contents of which are incorporated by reference herein in their entirety, which describes technology that enables an accurate measurement of a drum's pitch.

Figure 6:
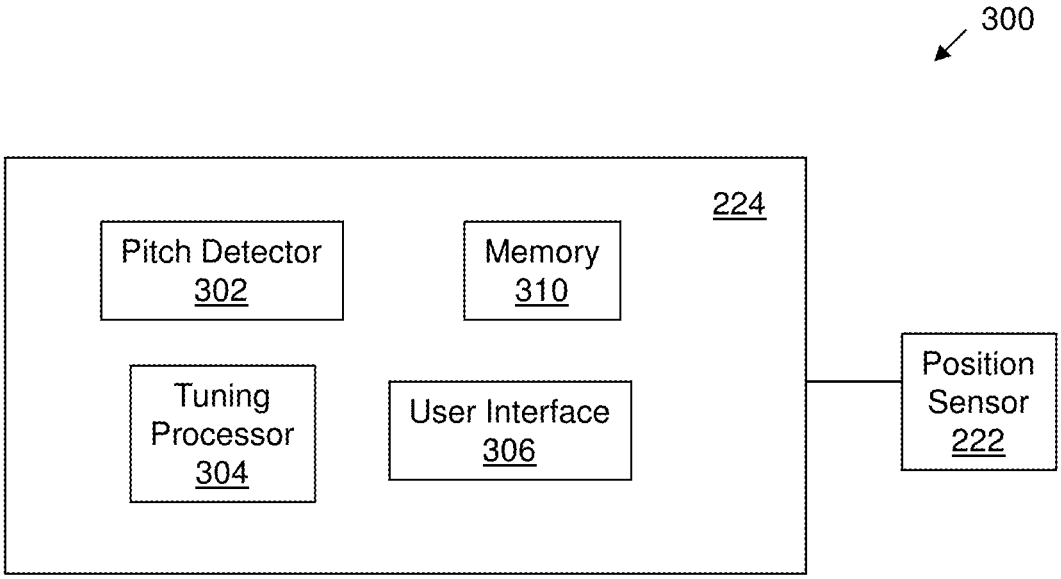
FIG. 6 is a block diagram of a timpani tuning system, in accordance with an embodiment.

In an embodiment, the control unit 224 of the timpani tuning system 220 determines a pitch generated at the timpano 200, thereby obviating the need to try to decipher the pitch by ear. The sensor 222 attached to the tuning pedal 212 can measure a position of the pedal 212, for example, an angle of the pedal 212 relative to a surface a pedal support 242 at which the pedal 212 is movably, e.g., rotatably, coupled via a pivot point 232. In an embodiment, an inclinometer based on a two or three axis accelerometer is provided for measuring the angle. Alternatively a rotary potentiometer can be implemented, or an optical angular sensor. The system 220 can include a connector 226 between the position sensor 222 and the control unit 224. In one embodiment, the connector 226 is a wired cable, for example, shown in FIGS. 4 and 5. In another embodiment, the connector 226 is a wireless link (not shown). The pitch information determined by the control unit 224 and the pedal position information determined by the sensor 222 are used to calibrate and equalize the timpano 200, and to determine an estimated timpano pitch for each of one or more particular pedal positions. Any position sensor known to those of ordinary skill in the art can be implemented that measures the displacement or rotation of either the hoop or any other element of the tensioning linkage relative to some fixed reference FIG. 6 is a block diagram of a timpani tuning system 300, in accordance with an embodiment. The tuning system 300 can include a control unit 224 and a position sensor 222 similar to or the same as those described in FIGS. 4 and 5.

The control unit 224 includes a pitch detector 302, a tuning processor 304, a user interface 306, a memory 310.

The pitch detector 302 can detect a signal corresponding to a pitch from the timpano head 204. The pitch detector 302 can include a microphone or the like.

A mode selection switch, button, or the like can be part of the user interface 306 and can be used to place the tuning system 300 in at least one of a calibration mode, performance mode, or a equalization mode.

The calibration mode permits the tuning system 300 to be calibrated by measuring and recording the pitch and corresponding pedal position for a range of pedal positions determined by the user. A calibration curve or the like can be formed from the pedal position data and corresponding measured pitch data for tuning timpani with precision. A calibration clear input can be provided on the user interface 106 to enable the user to erase calibration data prior to performing a new calibration procedure. In addition, a calibration done input can be provided on the user interface 106 to enable the user to terminate collection of calibration data, for example after the pedal is at the opposite end of the adjustment range and a sufficient number of data samples have been acquired. The user interface 106 can also include a calibration store and recall input to enable the user store and recall calibration curves.

In the performance mode, also referred to as a normal mode, the tuning system 300 can generate and display an estimated pitch result from the calibration data.

In the equalization mode, pitch determinations near the tension screws 110, or lugs or the like, around the perimeter of the drum information can be made, and can permit a user to adjust one or more tension screws 110 so that the pitches of the drum regions proximal the tension screws are the same or similar to each other and/or to a reference pitch against which each pitch measurement is compared. The reference pitch can be a specific musical note or frequency selected with the user interface. The reference pitch can also be a pitch measured from the timpano if so specified with the user interface. All readings can be matched to the user-specified note or frequency.

In the equalization mode, readings can be displayed so as to indicate the deviation from the reference pitch. The deviation can be displayed several ways: as a needle dial, a spinning disk, a numerical value in musical note units of cents or as a frequency in units of Hertz. After striking the timpano 200 near one of the tension screws 110, the pitch associated with that tension screw 110 is displayed as the difference between the measurement and the reference pitch. This equalization mode display allows the timpanist to go around the drum from tension screw to tension screw and adjust each one for a reading close to zero and thereby equalize the drum by uniformly tuning it to the reference pitch When the mode selection module 312 is set as a calibration mode, the pitch detector 302 can measure pitch data and the position sensor 222 can determine a corresponding pedal position for a range of pedal positions. This data can be stored at the memory 310, for example, a computer readable storage medium. More specific examples (a non-exhaustive list) of the computer readable storage medium can include a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing.

The tuning processor 304 receives the calibration data, for example, from the memory 310 and/or from the pitch detector 302 and position sensor 222, respectively, and can estimate a timpani pitch corresponding to a particular pedal position as determined by the pedal, hoop or linkage position sensor 222 in view of the calibration data. The tuning system 300 can apply standard regression or modeling techniques to fit the data to a curve so that the timpano pitch can be estimated for an arbitrary pedal position, as determined by the pedal position sensor 222. Table-based techniques can also be used for estimating the pitch from the calibration data.

The user interface 306 processes data related to any of the abovementioned modes for output to the electronic display 228. The data can include a measured pitch, for example, provided by the pitch detector 202, and/or an estimated pitch, for example, generated by the tuning processor 304, depending on whether the mode selection module 312 indicates that the system 300 is in a calibration mode or a performance mode. In a calibration mode, the user interface 306 can provide for the display 228 a measured pitch, which can be displayed as the nearest musical note and the deviation. The deviation can be displayed as a numerical value or on a needle dial, or a spinning disk, or related presentation vehicle. In a performance mode, the user interface 306 can provide for the display 228 an estimated timpano pitch corresponding to the instantaneous pedal position. The display 228 will typically show the nearest musical note along with a needle, or some other indication such as a spinning dial, to indicate how sharp or flat the drum pitch is relative to the displayed note. This enables a timpanist to adjust the pedal, or provide a fine tuning adjustment to come very close to the pitch of the desired musical note prior to striking the head. In performance mode, the display 228 can also show the measured pitch from the latest strike of the timpano and can also display the deviation of the measured pitch from the estimated pitch for that pedal position. In performance mode, measured pitch and position data can also be acquired and can be used to update the calibration result.

In an embodiment, the tuning system 300 can be useful for changing the pitch while the kettle drum is still resonating, a technique that is sometimes required. For example, when configured in performance mode, the display of an estimated note will automatically change as the pedal moves to thereby aid the timpanist in correctly modifying the pitch.

The display 328 can display information presented by the user interface 306, for example, pitch measurement values, calibration results, estimated pitch data, comparison results between measured pitch data and reference pitch data, and/or related information, for example, described herein.

Figure 7:
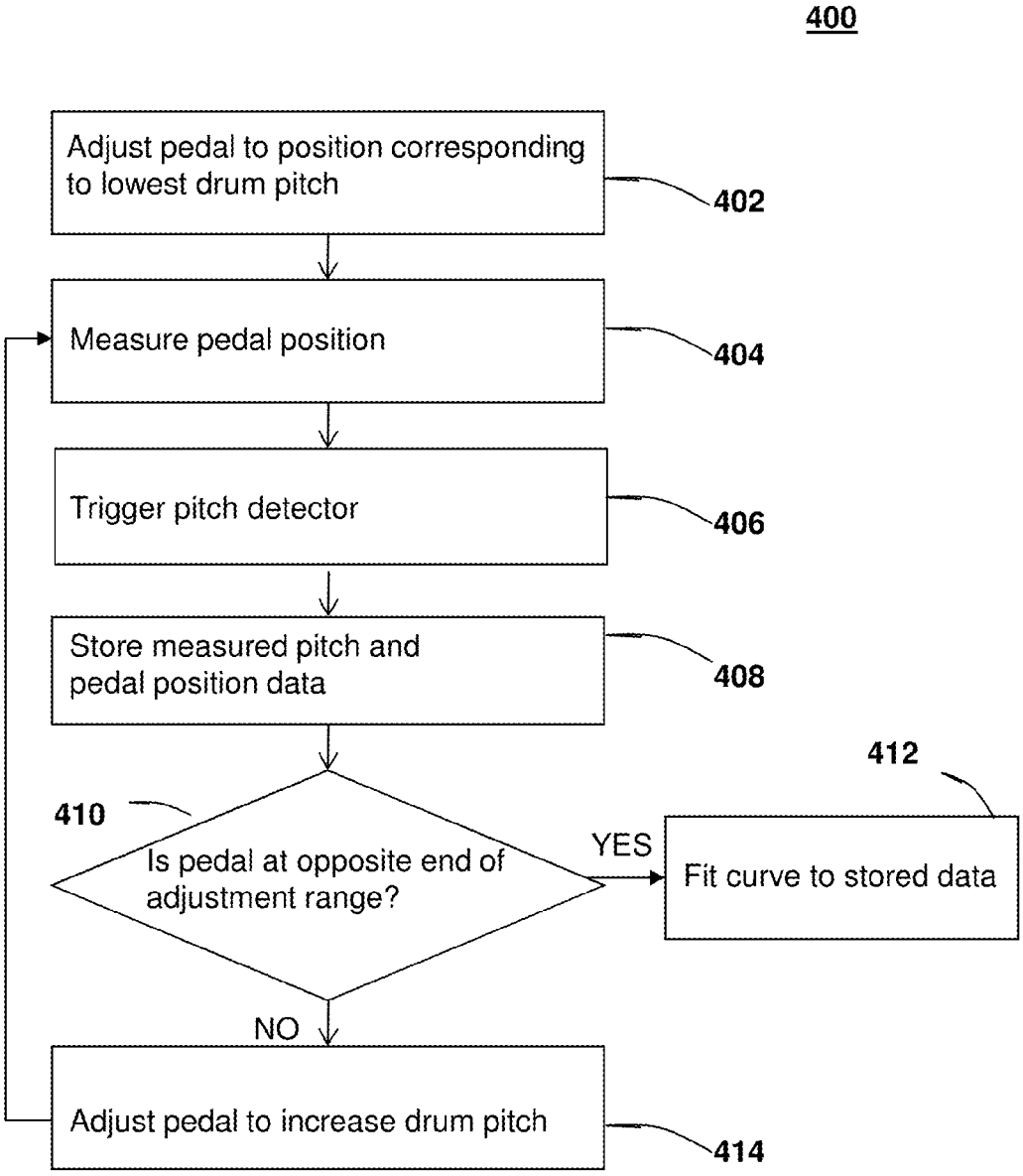
FIG. 7 is a flow diagram of a method for tuning a timpano, in accordance with an embodiment.

FIG. 7 is a flow diagram of a method 400 for tuning a timpano, in accordance with an embodiment. In describing the method 400, reference is made to elements of FIGS. 4-6. The method 400 is preferably performed when the tuning system 300 is configured for a calibration mode. The method 400 can equally apply to other percussion instruments known to those of ordinary skill in the art.

At block 402, the timpano pedal 212 is adjusted to a position corresponding to a lowest pitch of the timpano 200. This position will be with the pedal 212 at one end of its travel, either all the way up as shown at insert P1 of FIG. 4 or all the way down as shown at insert P2 of FIG. 4. The position of the timpani pedal 212 corresponding to the lowest pitch of the timpani 200 depends on the make, model, or related features of the timpano 200. The lowest pitch of the timpani 200 can be determined from a set of measured pitches, for example, detected in response to the timpani 200 being struck.

At block 404, the position of the pedal 212 is measured, more specifically, the position of the pedal 212 corresponding to the lowest pitch of the timpano 200. This data can be determined by the position sensor 202. In an embodiment, the determined position data includes the angle of the pedal in degrees or some other unit of angular measurement.

At block 406, the pitch detector 302 of the control unit 224 is triggered. The pitch detector 302 can be triggered in response to a user applying a force to the head 204, for example, using a mallet to hit the surface of the head 204. Here, the pitch detector 302 can detect a timpani pitch, for example, determine a frequency, when the head 104 is at a particular tension corresponding to the location of the pedal. A visual indicator can be activated to provide a visual indication of the triggering of the pitch detector 302. For example, a light emitting diode (LED) at the control unit 224 can flash or otherwise illuminate. The measured pitch can appear on the display 228, for example, presented as a value by the user interface 306. The nearest musical note to the measured frequency can alternatively or in addition be displayed, along with an indication of how sharp or flat it is relative to the nearest note.

At block 408, data related to the measured pitches and associated pedal positions can be stored in the memory 310, or another storage location, for example, in a table stored in a database.

At decision diamond 410, a determination is made whether the pedal 212 is at the opposite end of the adjustment range or if a calibration done input is received from user interface 306. If the pedal 212 is determined to be at the opposite of the adjustment range or if a calibration done input is received, the method 400 proceeds to block 412, where the process exits the loop, and a curve-fitting technique or regression technique is applied to the data stored according to block 408. Embodiments of such techniques are described herein, for example, at FIG. 8. Otherwise, the method 400 proceeds to block 414, where the pedal 212 is adjusted in a manner that increases the drum pitch, then to block 404. The entire calibration method shown in FIG. 7 and described herein, can alternatively commence with the pedal position corresponding to highest timpano pitch and proceed to the pedal position of lowest timpano pitch and provide an equivalent result.

Figure 8:
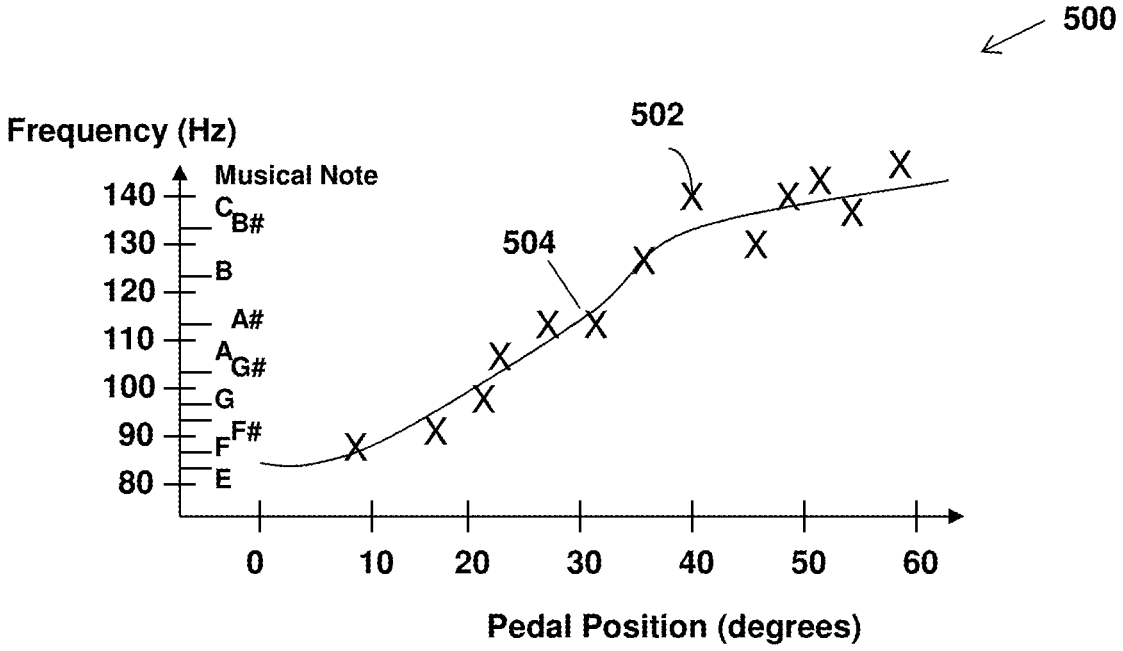
FIG. 8 is a graph of a calibration curve generated according to the method of FIG. 7, in accordance with an embodiment.

FIG. 8 is a graph 500 of a calibration curve, in accordance with an embodiment. The calibration curve illustrates a plurality of data points 502 taken during a calibration procedure, for example, according to the method 400 described herein, along with a continuous curve 504 that is fitted to the data points 502. The data points 502 refer to calibration data points taken by the tuning system 300 that determines and stores a frequency and/or note corresponding to a pitch and corresponding pedal position over a range of pedal positions.

The x-axis of the graph corresponds to the position of the pedal 212 as detected by the position sensor 222, measured in degrees of the angle of the pedal with respect to any arbitrary reference position. The y-axis corresponds to the measured or estimated pitch of the timpano 200, measured in frequency, or a musical note.

Figure 9:
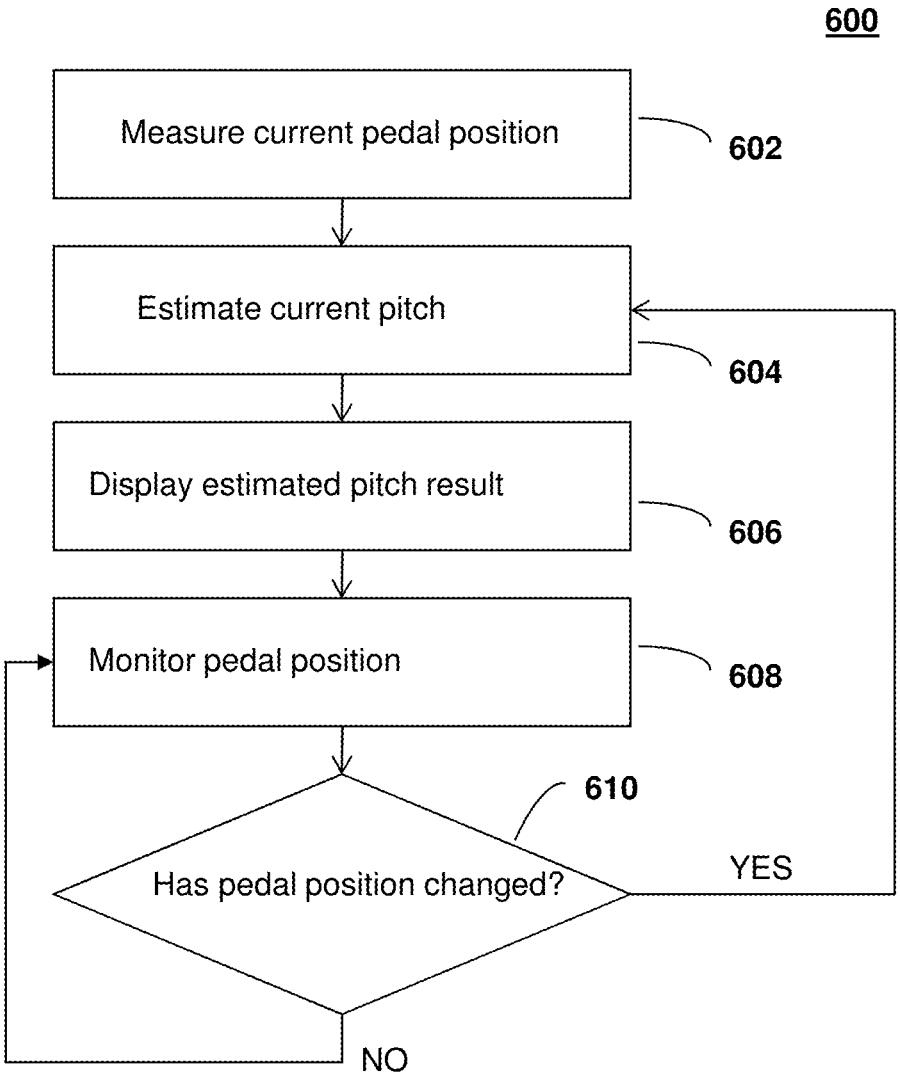
FIG. 9 is a flow diagram of a method for tuning a timpano, in accordance with an embodiment.

FIG. 9 is a flow diagram of a method 600 for tuning a timpano, in accordance with an embodiment. In describing the method 600, reference is made to elements of FIGS. 4-8. The method 600 is preferably performed when the tuning system 300 is configured for a performance mode. The method 600 can equally apply to other percussion instruments known to those of ordinary skill in the art.

At block 602, a current position of the pedal 212 is measured. The pedal 212 can be positioned anywhere along a path shown in FIG. 4.

At block 604, a current pitch is estimated that corresponds to the current pedal position determined at block 602. The current pitch can be estimated using a fitted curve, for example, the calibration curve 500 shown at FIG. 8 by determining the pitch corresponding to the current pedal position from the calibration curve 500. Alternatively a table could be used or a mathematical model could be used to estimate the current pitch.

At block 606, the estimated pitch result is displayed. The estimated pitch result can appear on the display 228, for example, presented as a value by the user interface 306. In an embodiment, the value is displayed as the nearest musical note. Alternatively, or in addition, the measured frequency can be displayed. Other related information such as the amount that note is sharp or flat can be displayed At block 608, the pedal position is monitored. Here, the sensor 222 attached to the tuning pedal 212 can measure the position, for example, an angle, of the pedal 212. At decision diamond 610, a determination is made whether the pedal position has changed. If it is determined that the pedal position has changed, then the method 600 proceeds to block 604, where a current pitch corresponding to the pedal position is estimated. Otherwise, the method 600 proceeds to block 608. The display will continue to display the currently estimated pitch until the position changes.

Figure 10:
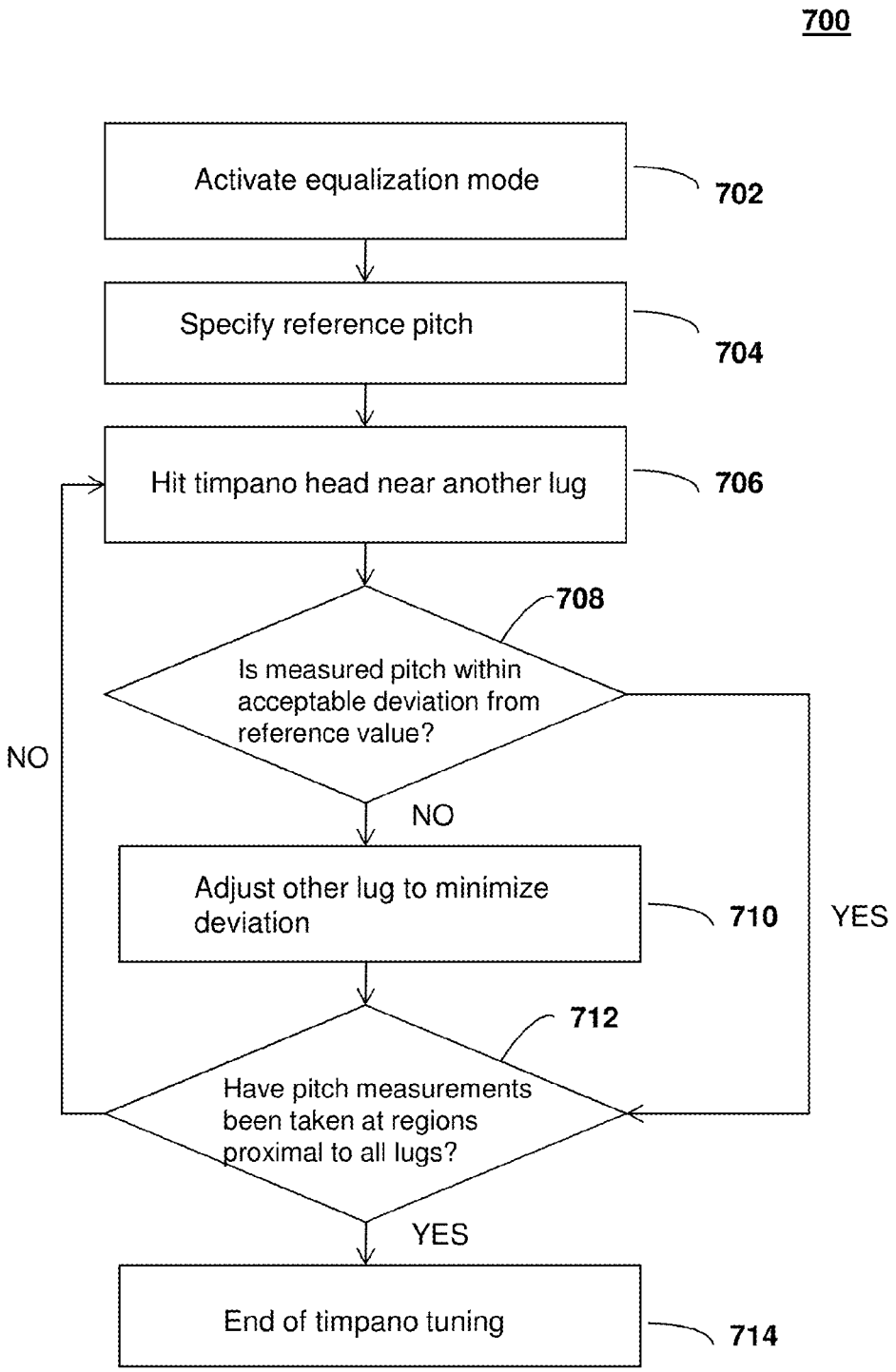
FIG. 10 is a flow diagram of a method for tuning a timpano, in accordance with an embodiment.

FIG. 10 is a flow diagram of a method 700 for tuning a timpano, in accordance with an embodiment. In describing the method 700, reference is made to elements of FIGS. 4-6. The method 700 is preferably performed when the tuning system 300 is configured for an equalization mode, for example, described herein. The method 700 can equally apply to other percussion instruments known to those of ordinary skill in the art.

At block 702, an equalization mode is activated.

At block 704, a reference pitch is specified. The reference pitch can be subtracted from subsequent triggered measurements to calculate a frequency difference. The resulting frequency difference can be displayed in Cents, Hz, or related unit of measurement, and/or as a visual indication such as a needle gauge or a spinning disk.

At block 706, the timpani head 204 is hit at a region near another lug or the like at a different location of the head 204 than the lug of block 702. The impact is sufficient to trigger the pitch detector 302 of the control unit 224. The control unit 224 can include an LED or other indicator that can flash or otherwise generate a signal indicating that the timpani head 204 received a force. A pitch or the like is measured in response to the detected force.

At decision diamond 708, a determination is made whether the measured pitch at the region of the head 204 proximal the other lug at block 706 is within a predetermined acceptable deviation from the reference pitch. The deviation value is determined by calculating a difference between the reference value and the measurement taken at block 706. If the resulting deviation value is at or less than a predetermined deviation value, for example, then the method 700 proceeds to decision diamond 712, where a determination is made whether all relevant pitch measurements have been taken. Otherwise, the method 700 proceeds to block 710, where the lug is adjusted to minimize the deviation from the reference value. Additional measurements can be taken by a user by tapping the region of the head 204 after adjusting the lug and measuring the pitch to determine whether the difference between the reference value and the new measurement value is reduced to fall within an acceptable deviation range.

Returning to decision diamond 712, if all relevant measurements are taken, then the method 700 proceeds to block 714, where a determination is made that the tuning process is complete, and more specifically, the pitch deviation at all relevant lugs is at an acceptable value, i.e., at or less than a predetermined threshold. Otherwise, the method 700 proceeds to block 706, where a pitch measurement or the like is taken at another lug of the timpano.

While the present invention has been shown and described herein with reference to specific embodiments thereof, it should be understood by those skilled in the art that variations, alterations, changes in form and detail, and equivalents may be made or conceived of without departing from the spirit and scope of the invention. Accordingly, the scope of the present invention should be assessed as that of the appended claims and by equivalents thereto.

What is claimed is:

1. A percussion instrument tuning system, comprising:

a position sensor that determines at least one first position of a tuning mechanism of a timpano; and a control unit that generates a calibration result by measuring a first pitch of the timpano corresponding to the at least one first position of the tuning mechanism, and that estimates a second pitch corresponding to an instantaneous second position of the tuning mechanism from the calibration result and displays the estimated second pitch of the timpano corresponding to at least one second position.

2. The percussion instrument tuning system of claim 1, wherein the control unit comprises a pitch detector that measures the pitch from the timpano, the calibration result generated from the measured pitch.

3. The percussion instrument tuning system of claim 2, wherein the pitch detector measures the pitch of a lowest overtone.

4. The percussion instrument tuning system of claim 1, wherein the control unit comprises a tuning processor that processes the calibration result to determine a value of the estimated second pitch corresponding to the at least one second position of the tuning mechanism of the timpano.

5. The percussion instrument tuning system of claim 1, wherein the control unit comprises a user interface that provides data for display that is related to at least one of a calibration mode, a performance mode, and an equalization mode.

6. The percussion instrument tuning system of claim 5, wherein the calibration result is generated in the calibration mode.

7. The percussion instrument tuning system of claim 5, wherein the estimated second pitch is displayed in the performance mode.

8. The percussion instrument tuning system of claim 5, wherein a reference pitch is compared to a measured pitch and a difference between the reference pitch and the measured pitch is displayed in the equalization mode.

9. The percussion instrument tuning system of claim 1, wherein the calibration result determined by the control unit and the tuning mechanism position information determined by the sensor are used to determine an estimated timpano pitch for each of one or more tuning pedal positions.

10. The percussion instrument tuning system of claim 1, wherein the tuning mechanism includes a pedal, and wherein the position sensor measures an angle of the pedal with respect to a reference position.

11. A method for tuning a timpano, comprising:

determining at least one first pedal position of a timpano;

generating a calibration result by measuring a first pitch of the timpano corresponding to the at least one first position of the tuning mechanism;

estimating a second pitch of the timpano corresponding to at least one second position of the tuning mechanism-from the calibration result; and displaying the estimated second pitch.

12. The method of claim 11, wherein generating the calibration result further comprises:

adjusting the tuning mechanism to a position corresponding to a lowest or highest pitch of the timpano;

measuring the position of the tuning mechanism; and adjusting the tuning mechanism to increase or decrease a pitch of the timpano; and applying a calibration curve to stored data of the pitch and corresponding position of the tuning mechanism.

13. The method of claim 11, further comprising measuring a pitch of a lowest overtone.

14. The method of claim 11, further comprising processing the calibration result to determine a value of the estimated second pitch corresponding to the at least one second position of the tuning mechanism of the timpano.

15. The method of claim 11, further comprising displaying data that is related to at least one of a calibration mode, a performance mode, and an equalization mode.

* * * * *